US005280329A

United States Patent [19]

Akiyama et al.

[11] Patent Number: 5,280,329

[45] Date of Patent: Jan. 18, 1994

[54] FIXING DEVICE

[75] Inventors: Ryozo Akiyama; Yoshimitsu Ohtake, both of Shizuoka

[73] Assignee: Tokyo Electric Co., Ltd., Tokyo, Japan

[21] Appl. No.: 922,386

[22] Filed: Jul. 31, 1992

[30] Foreign Application Priority Data

Aug. 8, 1991 [JP] Japan ..... 3-198988
Oct. 3, 1991 [JP] Japan ..... 3-256287

[51] Int. Cl.[5] ..... G03G 15/20

[52] U.S. Cl. ..... 355/285; 219/216; 219/505

[58] Field of Search ..... 355/282, 285, 289, 290, 355/295; 219/216, 504, 505; 29/130, 132; 432/60; 428/428

[56] References Cited

U.S. PATENT DOCUMENTS

| | | | |
|---|---|---|---|
| 3,715,550 | 2/1973 | Harnden, Jr. et al. | 219/504 X |
| 3,928,837 | 12/1975 | Esper et al. | 338/22 R |
| 4,025,751 | 5/1977 | Wright | 219/216 |
| 4,299,887 | 11/1981 | Howell | 428/428 |
| 4,406,722 | 9/1983 | Chow et al. | 156/89 |
| 4,482,239 | 11/1984 | Hosono et al. | 219/216 X |
| 4,544,828 | 10/1985 | Shigenobu et al. | 219/216 |
| 4,580,033 | 4/1986 | Sakurai | 219/216 |
| 4,724,305 | 2/1988 | Iimura et al. | 219/469 |
| 4,842,944 | 6/1989 | Kuge et al. | 428/451 |
| 4,883,715 | 11/1989 | Kuge et al. | 29/132 X |
| 5,052,099 | 10/1991 | Taguchi et al. | 29/603 |

FOREIGN PATENT DOCUMENTS

| | | |
|---|---|---|
| 0019491 | 11/1980 | European Pat. Off. . |
| 0241714 | 10/1987 | European Pat. Off. . |
| 0429088 | 5/1991 | European Pat. Off. . |
| 3107290 | 1/1982 | Fed. Rep. of Germany . |
| 63-27834 | 6/1988 | Japan . |

OTHER PUBLICATIONS

Database WPIL, AN 86-221241 [34], JP-A-61 151 069, Jul. 9, 1986.

Xerox Disclosure Journal, vol. 4, No. 2, Mar./Apr. 1979, pp. 131-132, D. A. Seannor, et al., "Alloys for Bare Metal Fuser Members".

Xerox Disclosure Journal, vol. 4, No. 2, Mar./Apr. 1979, pp. 277, J. A. Swift, "Fuser Roll Having Etched Surface".

*Primary Examiner*—Leo P. Picard
*Assistant Examiner*—Christopher Horgan
*Attorney, Agent, or Firm*—Oblon, Spivak, McClelland, Maier & Neustadt

[57] ABSTRACT

Disclosed herein is a fixing device comprising a heater which is formed of a heating element produced by dispersing particles of ceramic having a negative resistance-temperature coefficient into a binding member. The heater is formed by mounting a heat-shrinkable tubing on the heating element. A heating temperature of the heater is adjusted based on the thickness of the heat-shrinkable tubing. In addition, the heating element is covered by the heat-shrinkable tubing so as to reduce its high surface roughness.

14 Claims, 5 Drawing Sheets

FIXING DEVICE

FIELD OF THE INVENTION AND RELATED ART STATEMENT

The present invention relates to a fixing device suitable for use in an electrophotographic apparatus.

There is known a fixing device employed in an electrophotographic apparatus, which has a structure wherein a heater is incorporated in one of a pair of fixing rollers disposed with a path for conveying a recording medium such as a printing sheet or the like interposed therebetween. This type of fixing device is constructed in such a manner that toners transferred onto the recoding medium are heated and melted by heater and pressed under pressure, thereby fixing the toners on the recording medium.

A fixing device of a type wherein the heating temperature of the heater of the above-described fixing device can be automatically kept constant by forming the heater from a heating element having a positive resistance-temperature coefficient, has been disclosed in Japanese patent application Publication No. 64-4176, for example. The fixing device, which has been disclosed therein, will now be described as a conventional example with reference to FIG. 9. First of all, the fixing device 1 is of a structure wherein a fixing roller 2 serving as a heater is pressed against a presser roller 3 under given nip amount or pressure. The presser roller 3 is constructed in such a manner that an elastic body or member 5 such as fluorinated ethylene resin, silicone rubber is formed on a cylindrical support member 4 such as a metal. Further, the fixing roller 2 is constructed such that a coat 6 such as fluorinated ethylene resin, silicone rubber is formed on a cylindrical heating element 7. The heating element 7 has a positive resistance-temperature coefficient set by dispersing particles of ceramic into a binding member such as glass, silicone rubber.

The fixing device 1 constructed as described above is placed on a path for conveying a printing sheet 9 serving as a recording medium to which toners 8 for an electrophotographic apparatus (not shown) have been transferred. The toners 8 transferred to the printing sheet 9 is melted by heat generated from the heating element 7 and simultaneously pressed under pressure between the rollers 2 and 3, thereby fixing the toners 8 on the printing sheet 9. The resistance-temperature coefficient of the heating element 7 in the fixing roller 2 is positive in the fixing device 1. Therefore, an increase in temperature at the start of energization of the heating element 7 is efficiently made and the heating temperature of the heating element 7 is kept constant without controlling output power to be applied. Now, the heating element 7 having the positive resistance-temperature coefficient corresponds to a thermistor whose resistance is raised with an increase in temperature. Since the balance between the resistance and the applied power is kept constant by a predetermined heating temperature, a heater whose heating temperature is constant can be formed without the need for a thermodetecting element and a power control circuit.

On the other hand, a heating element having a positive resistance-temperature coefficient, which can be formed by mixing electrically-conductive fine particles with a crystalline macromolecular material and using various materials having negative resistance-temperature coefficients, has been disclosed in Japanese patent application Publication Nos. 59-10553 and 58-58793 as another means for molding the heating element having the positive resistance-temperature coefficient as described above.

According to the fixing device 1 disclosed in Japanese patent application Publication No. 64-4176, the fixing roller 2 serving as the heater whose heating temperature is self-controlled, has been realized by the heating element 7 formed by dispersing the particles of the ceramic having the positive resistance-temperature coefficient into the binding member. However, only barium titanate or the like has not been put to practical use as the ceramic having the positive resistance-temperature coefficient as described above. Thus, a difficulty in choice of a desired material for the ceramic interferes with the productivity and utility of the fixing device.

On the other hand, the heating element having the positive resistance-temperature coefficient, which has been disclosed in Japanese patent application Publication Nos. 59-10553 and 58-58793, can be formed of the various materials. In the above disclosures, carbon blacks and graphite have been shown as the electrically-conductive fine particles. However, since such materials are relatively low in heating temperature, they cannot be applied to the heater of the fixing device, which requires a high heating temperature.

The present invention is to obtain a fixing device capable of easily selecting a desired material for a heater comprised of a heating element having a positive resistance-temperature coefficient and providing a high heating temperature from the heater. Further, the present invention is to obtain a fixing device which is superior in fixing performance and productivity.

OBJECT AND SUMMARY OF THE INVENTION

A first object of the present invention is to obtain a fixing device capable of easily selecting a desired material used for a heater.

A second object of the present invention is to obtain a fixing device capable of providing a heater having a high heating temperature.

A third object of the present invention is to obtain a fixing device capable of providing a heater free of a toner offset.

A fourth object of the present invention is to obtain a fixing device capable of providing a heater whose separation characteristic is satisfactory.

A fifth object of the present invention is to obtain a fixing device which is superior in productivity.

A sixth object of the present invention is to obtain a fixing device capable of providing superb fixing performance.

According to one aspect of the fixing device of the present invention for heating toner images formed on a recording medium with a heater to thereby fix the toner images on the recording medium, the heater is formed of a heating element obtained by dispersing particles of ceramic having a negative resistance-temperature coefficient into a binding member. Therefore, the heater having a positive resistance-temperature coefficient can be formed by the ceramic whose material can be easily selected and has a high igniting temperature.

According to another aspect of the fixing device of the present invention for heating toner images formed on a recording medium with an outer peripheral surface of a heater so as to fix the toner images on the recording medium, a heating element formed by dispersing particles of ceramic having a negative resistance-temperature coefficient into a binding member is shaped in the form of a cylinder and a heat-shrinkable tubing is mounted on the outer peripheral surface of the heating element, thereby forming the intended heater. Therefore, the selection of a material for the formation of the heating element is facilitated and hence the heater having a high heating temperature can be obtained by using such a heating element. The heating temperature of the heater is adjusted based on the thickness of the heat-shrinkable tubing so as to be associated with the temperature for fixing toners. The heating element can be covered with the heat-shrinkable tubing so as to reduce its high surface roughness, thereby making it possible to prevent a toner offset from being developed in the heater. Thus, the fixing device having superb fixing performance can be obtained.

According to a further aspect of the fixing device of the present invention the roughness of the outer peripheral surface of the heating element ranges from 30(μm) to 80(μm). Therefore, the heat-shrinkable tubing can be reliably mounted on the heating element under the action of heat shrinkage. In addition, the separation characteristic of the heater can be improved. Thus, the fixing device, which is superior in productivity and fixing performance, can be obtained.

According to yet another aspect of the fixing device of the present invention the surface roughness and the thickness of the heat-shrinkable tubing are determined so as to meet the following equation:

$$R \leqq t \leqq 60R$$

where R: surface roughness t: thickness of heat-shrinkable tubing.

Therefore, the heat-shrinkable tubing can be reliably mounted on the heating element under the action of heat shrinkage. In addition, the heating temperature and the separation characteristic of the heater can be improved. Thus, the fixing device, which is superior in productivity and fixing performance, can be obtained.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF PREFERRED EMBODIMENTS

Figure 1:
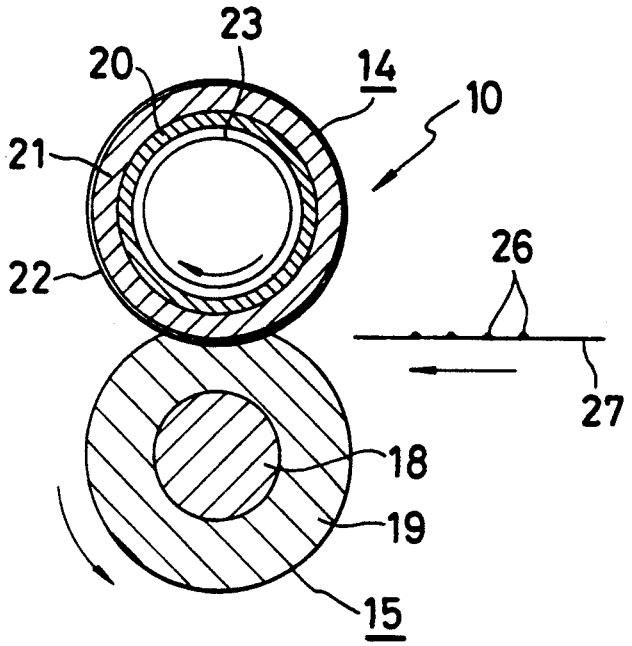
FIG. 1 is a vertical cross-sectional view showing a fixing device according to one embodiment of the present invention.
Figure 2:
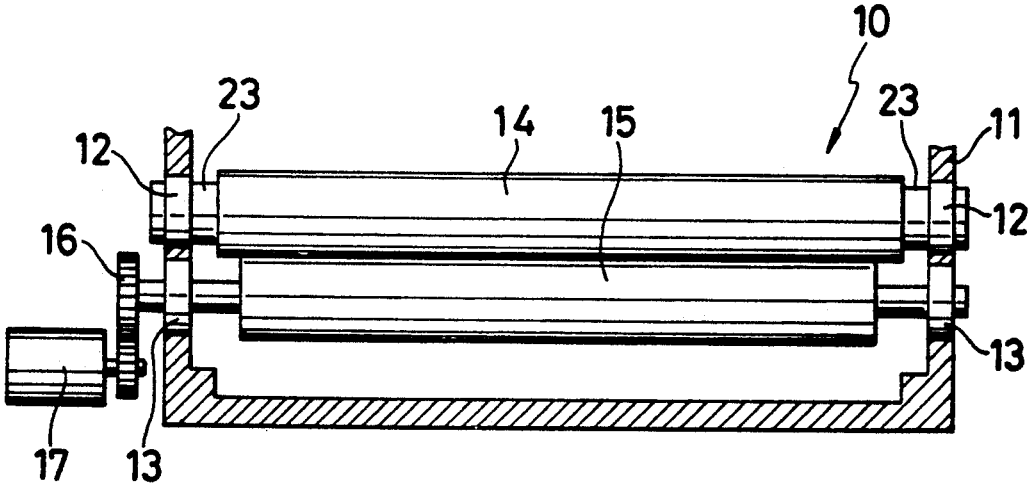
FIG. 2 is a plan view showing the fixing device illustrated in FIG. 1.
Figure 3:
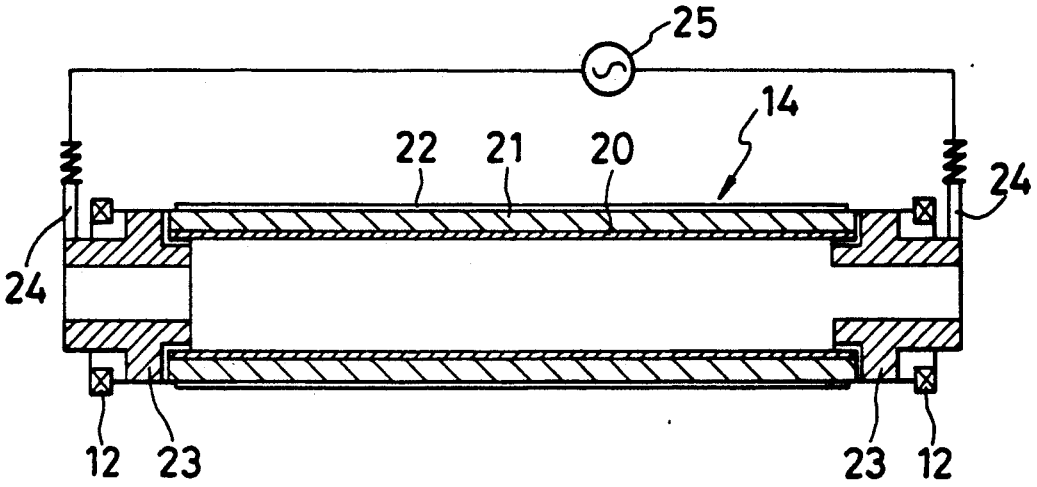
FIG. 3 is a vertical sectional front view showing the fixing device shown in FIG. 1.

A fixing device according to one embodiment of the present invention will hereinafter be described in detail with reference to FIGS. 1 through 5. The fixing device 10 is constructed as shown in FIG. 2. That is, a fixing roller 14 serving as a heater and a presser roller 15 both of which are rotatably supported by insulating bearings 12, 13 disposed in a body housing 11, are held in abutment against each other under predetermined nip amount or pressure. As illustrated in FIG. 1, the presser roller 15 to which a drive motor 17 is coupled via a gear train 16, is constructed in such a manner that an elastic member 19 such as silicone rubber, fluororubber is mounted on a cylindrical support member 18 such as a metal or the like. Further, the fixing roller 14 has a structure of a type wherein a heating body or element 21 is mounted on a support member 20 composed of glass or the like and shaped in the form of a cylinder, and a heat-shrinkable tubing 22 is mounted on the heating element 21 and has metallic flanges 23 attached to both ends thereof. As shown in FIG. 3, a constant voltage source 25 is electrically connected via brushes 24 to the flanges 23 which extend through the insulating bearings 12.

In the fixing device 10 constructed as described above, the heating element 21 having a positive resistance-temperature coefficient is formed by dispersing particles of ceramic having a negative resistance-temperature coefficient into a binding member. The heating element 21 thus formed has a surface roughness ranging from 30(μm) to 80(μm). In the fixing device 10 as well, the heat-shrinkable tubing 22 referred to above is mounted on the heating element 21 under the action of its own heat shrinkage. The thickness t of the heat-shrinkable tubing 22 relative to the surface roughness R of the outer peripheral surface of the heating element 21 is determined so as to meet the following expression:

$$R \leqq t \leqq 60R$$

Thus, the fixing device 10 constructed as described above is placed on a path for conveying a printing sheet 27 serving as a recording medium to which toners 26 for an electrophotographic printer (not shown) have been transferred. In addition, the toners 26, which have been transferred to the printing sheet 27, are melted by heat generated by the heating element 21 and simultaneously pressed under desired pressure between the fixing roller 14 and the presser roller 15 to thereby fix images on the printing sheet 27. In the fixing device 10, the resistance-temperature coefficient of the heating element 21 in the fixing roller 14 is positive. Therefore, an increase in temperature at the start of energization of the heating element 21 is satisfactory and the temperature for heating the toners 26 by the heating element 21 is kept constant without controlling the voltage output from the constant voltage source 25.

In the fixing device 10, the heating element 21 having the positive resistance-temperature coefficient is formed of the ceramic particles having the negative resistance-temperature coefficient as described above. Thus, since the material for the heating element 21 can be easily selected, they can contribute to an improvement in productivity and utility of the fixing device 10. Further, since the material has a high igniting temperature, the fixing device 10 which can provide a high heating temperature and is of utility, can be obtained.

Figure 6:
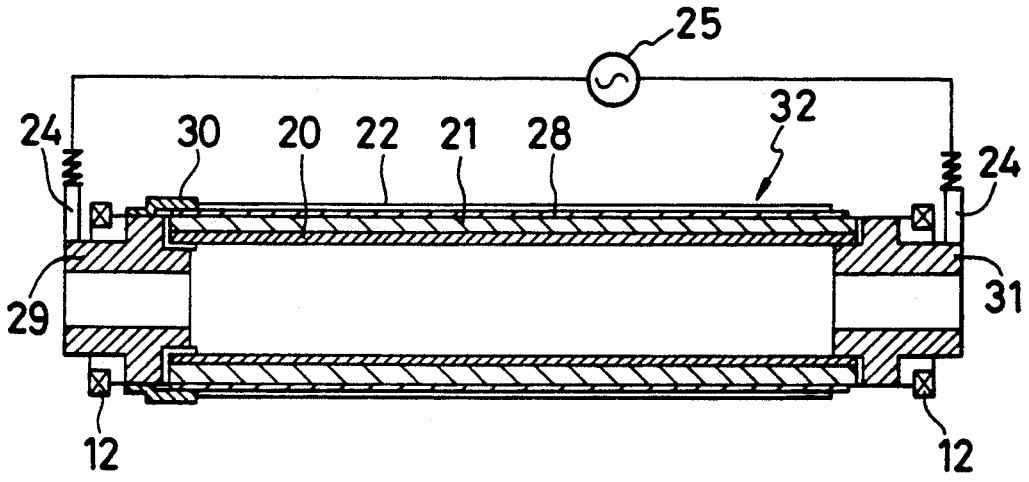
FIG. 6 is a vertical sectional front view depicting a first modification of the fixing device shown in FIG. 1.

Incidentally, the above-described fixing device 10 having the heating element 21 formed on the support member 20 having high rigidity, has been shown by way of illustrative example. However, the support member 20 can be omitted if the binding member having high rigidity is selected as the heating element 21. Further, in the fixing device 10 according to the present embodiment, the cylindrical heating element 21 is energized in the longitudinal direction thereof. However, the heating element 21 may also be energized in the thickness direction thereof. That is, an electrode layer 28 is formed on the outer peripheral surface of the heating element 21 mounted on the support member 20 made of a metal, by depositing silver, copper and nickel, etc. on the heating element 21 or by plating as illustrated in FIG. 6 by way of example. Then, the electrode layer 28 and one flange 29 are electrically connected to each other by an electrically-conductive member 30. In addition, the other flange 31 and the support member 20 are directly made conductive. It is thus possible to form a fixing roller 32 which energizes the heating element 21 in the thickness direction thereof. Incidentally, the support member 20 can be omitted even if such a fixing roller 32 is used. In this case, an electrode layer (not shown), which can make electrical connection to the flanges 29, 31, is formed even on the inner peripheral surface of the heating element 21.

In the heating element 21 which has been made on an experimental basis by the present applicant, an Mn-Zn ferrite corresponding to a spinel type ferrite single crystal is used as a ceramic having a negative resistance-temperature coefficient. In addition, polyether-etherketone corresponding to a thermoplastic resin is adopted as the material used for the binding member. Then, a base material formed of an Mn-Zn ferrite is ground in the form of grains each having an average diameter of 3(μm) and dispersed over the polyether-etherketone in the form of 50% by volume. Thereafter, this product is molded and hardened by an extrusion molding device so as to form the heating element 21. At this case, the heating element 21 is formed as a cylinder having an outer diameter of 16(mm), an inner diameter of 14(mm) and a length of 240(mm) so as to be energized in the thickness direction thereof. It has consequently been confirmed that the heating element 21 is highly precise in dimension, uniform even in material without any crack and can be efficiently mass-produced. It has also been confirmed by the present applicant that an excellent heating element 21 can be produced by setting the thickness T and the diameter D in such a manner that the relationship of $1/32 < T/D < \frac{1}{8}$ is satisfied when the cylindrical heating element 21 is produced.

Figure 4:
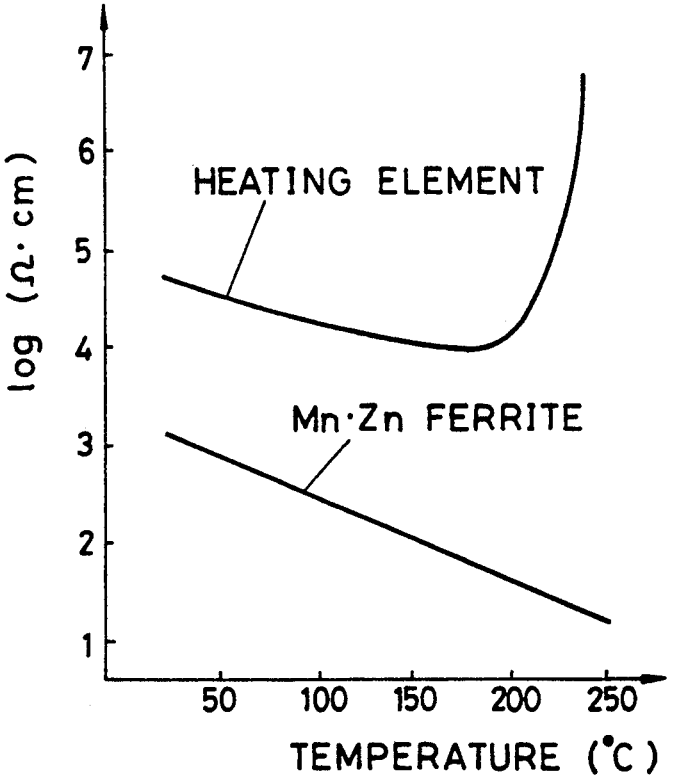
FIG. 4 is a characteristic graph illustrating resistance-temperature coefficients.
Figure 5:
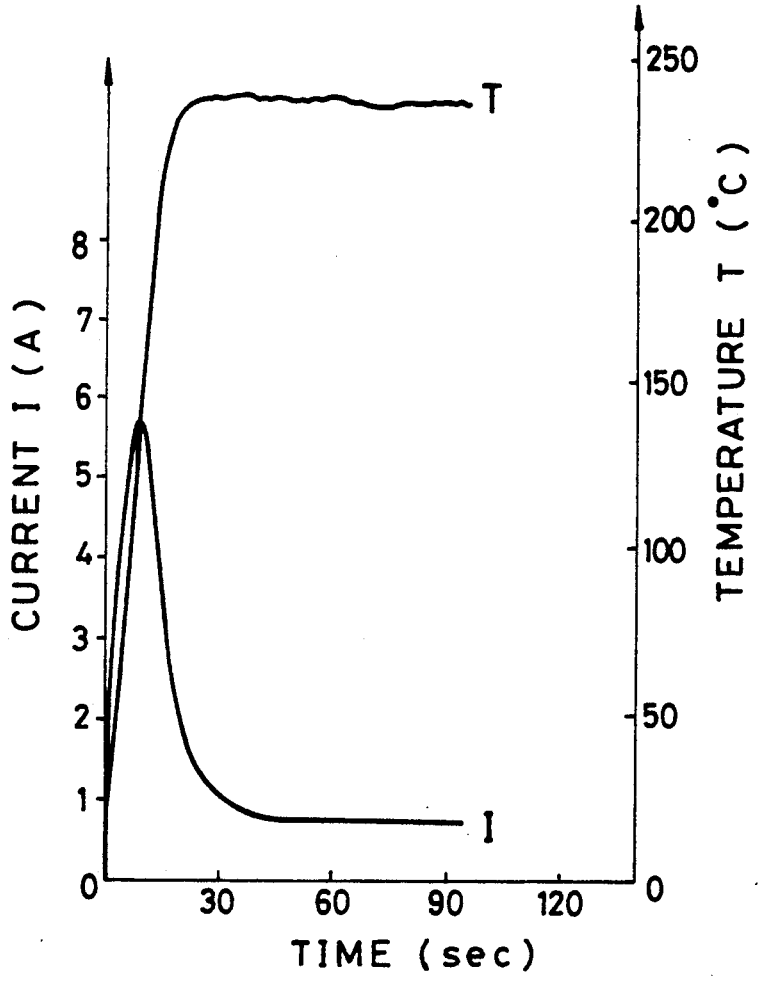
FIG. 5 is a characteristic graph showing variations in current value and temperature with respect to the time.

As a result of measurement of resistance-temperature coefficients of both the so-produced heating element 21 and the Mn-Zn ferrite, the resistance-temperature coefficient of the Mn-Zn ferrite is negative and that of the heating element 21 is positive at a temperature of 200° C. or higher as shown in FIG. 4. It has been confirmed as illustrated in FIG. 5 that when the heating element 21 is caused to conduct an alternating current of 100(V), its heating temperature reaches 230° C. after about 20(sec) has elapsed and is thereafter kept constant at a temperature of 230±5(°C.), and the amount of current is kept constant at about 0.8(A) after the heating element 21 has been placed under self-temperature control. That is, since the heating element 21 has a consumption power of $7.0\times10^{-3}$(A/cm$^2$) per unit area, a fixing operation can be realized at a consumption power of 100(W) or lower.

It has, however, been confirmed that since the heating element 21, which has been actually produced in the above-described manner, is high in surface roughness, its separation is hard to occur even when the heating element 21 has been coated with a heat-resistant protective coat or film and the toners 26 tend to adhere. The above heating element 21 has a heating temperature of 230(°C.), whereas each of several kinds of toners 26 has a fixing temperature of 200(°C.) or so, for example.

In the fixing device 10, the above-described two problems can be solved simultaneously by covering the heating element 21 with the heat-shrinkable tubing 22 having a predetermined thickness.

As described above, the heating temperature of the above heating element 21 has reached 230(°C.). Therefore, when a heat-shrinkable tubing 22 having a thickness of 350(μm) is first mounted on the above-described heating element 21, the temperature gradient of the heat-shrinkable tubing 22 ranges from 10° C. to 20° C. and the surface temperature of the fixing roller 14 reaches 210(°C.). Thus, in the fixing device 10, the surface temperature of the fixing roller 14 can be freely reduced by changing the thickness of the heat-shrinkable tubing 22 mounted on the heating element 21. It is therefore possible to improve the quality in printing by various kinds of toners 26.

A detailed description will now be made below of the results of comparisons among tests related to the separation of respective toners, which have been carried out by the present applicant. The heating element 21 made on the experimental basis by the present applicant as described above, has a surface roughness of about 50(μm). Therefore, when the heat-shrinkable tubing 22 having the thickness of 350(μm) is mounted on the heating element 21, the surface roughness of the fixing roller 14 reaches about 7(μm). Thus, comparison tests in fixing are then carried out between the fixing roller 14 having the heat-shrinkable tubing 22 mounted on the heating element 21 and a fixing roller (not shown) free of the heat-shrinkable tubing 22. It has consequently been confirmed that the toners 26 adhere to the surface of the fixing roller free of the heat-shrinkable tubing 22 and images on the printing sheet 27 are also inferior in quality, whereas the toners 26 do not adhere to the surface of the fixing roller 14 provided with the heat-shrinkable tubing 22 thereon and the images on the printing sheet 27 are also superior in quality.

Further, the present applicant has made, on an experimental basis, several kinds of heating elements 21 whose surface roughnesses are different from one another. As a result, the heating element 21 having a surface roughness of 30(μm) or below is low in adhesion and hence the heat-shrinkable tubing 22 slips from the heating element 21 during a period in which a fixing operation is executed, thereby rendering it incapable to fix the heat-shrinkable tubing 22 to the heating element 21. The heat-shrinkable tubing 22 can be fixed onto the heating element 21 by performing a primer process, for example. However, manufacturing steps increase to thereby reduce the efficiency of productivity of the fixing device 10. When, on the other hand, the heating element 21 has a surface roughness of 80(μm) or above, the surface roughness of the heat-shrinkable tubing 22 cannot be improved sufficiently. It has therefore been confirmed that the toners 26 tend to adhere.

That is, the heat-shrinkable tubing 22 can be reliably attached to the heating element 21 under heat shrinkage by setting the surface roughness of the heating element 21 in the fixing device 10 to a range of 30(μm) to 80(μm) as in the invention claimed in claim 5, thereby making it possible to contribute to an improvement in productivity. In addition, the separation of the fixing roller 14 can be facilitated to thereby contribute to an improvement in fixing performance.

It has been considered that a thick heat-shrinkable tubing 22 is used to improve the surface roughness of the fixing roller 14. However, the temperature gradient is steep so that the surface temperature of the fixing roller 14 becomes low excessively and the consumption power increases. Therefore, the present applicant has made, on an experimental basis, a fixing roller 14 by mounting several kinds of heat-shrinkable tubing 22 whose thicknesses t differ from one another on several kinds of heating elements 21 whose surface roughnesses R differ from one another. As a result, the surface roughness of the fixing roller 14 becomes high and the toners 26 tend to adhere when $t<R$. When, on the other hand, $60R<t$, the surface temperature of the fixing roller 14 is low excessively, so that a failure in fixing of the toners 26 is developed.

That is, the heat-shrinkable tubing 22 can be reliably attached to the heating element 21 under heat shrinkage by setting the surface roughness R of the heating element 21 of the fixing device 10 and the thickness t of the heat-shrinkable tubing 22 thereof so as to meet a relationship of $R \leqq t \leqq 60R$, thereby making it possible to contribute to an improvement in productivity. Further, the separation and the heating temperature of the fixing roller 14 can be rendered satisfactory to thereby contribute to an improvement in fixing performance.

Incidentally, various materials, which can provide both the heat resistance and the easy separation, can be used as the heat-shrinkable tubing 22 having the above-described characteristics. For example, PFA and FEP each of which is of a copolymer composed of tetrafluoroethylene and fluorinated ethylene unsaturated compound, and silicone rubber or the like are available.

As the above-described ceramic having the negative resistance-temperature coefficient, a composite $NiO$-$TiO_2$ series, $CoO$-$Al_2O_3$ series, $SnO_2$-$TiO_2$ series, etc., which are transition-metal oxides such as $NiO$, $Co_3O_4$, $Mn_3O_4$, $Cr_2O_3$, can also be used. As materials for binding members, polytetrafluoroethylene, polyphenylene sulfide and polyketone which are of crystalline resins, polyimide and polyether-imide which are of non-crystalline resins, etc., are available as well as silicone rubber, nitrile rubber, fluororubber, PFA resin, FEP resin, etc. which are superior in heat resistance.

The heating element 21 may also be formed by applying, on a support member 20 formed of glass or stainless steel or the like, a mixture obtained by mixing raw rubber such as RTV silicone rubber with particles of ferrite together with curing agent and a mixture of fine particles of a PFA resin and particles of ceramic, hardening the product in the same production method as the RTV silicone rubber, and molding the hardened product by grinding and cutting or the like. Further, the fixing roller can be directly produced by mixing alumina corresponding to an inorganic insulating material or ground particles of heat-resistant glass with ground particles of ceramic, melting the mixture at a temperature of 1200(°C.) or so and molding the product in the form of a cylinder by a glass forming technique.

When the heating element is formed of the binding member composed of the silicone rubber and the fluorine plastic as described above, such a macromolecular material has elasticity and the dispersed particles of the ceramic are prevented from being separated out of the heating element, thereby making it possible to improve serviceability and reliability of the heating element.

The term "negative resistance-temperature coefficient" described herein represents that the resistance is reduced with an increase in temperature. NTC (Negative Temperature Coefficient Thermistor) and CTR (Critical Temperature Resistor) or the like are contained as examples.

Figure 7:
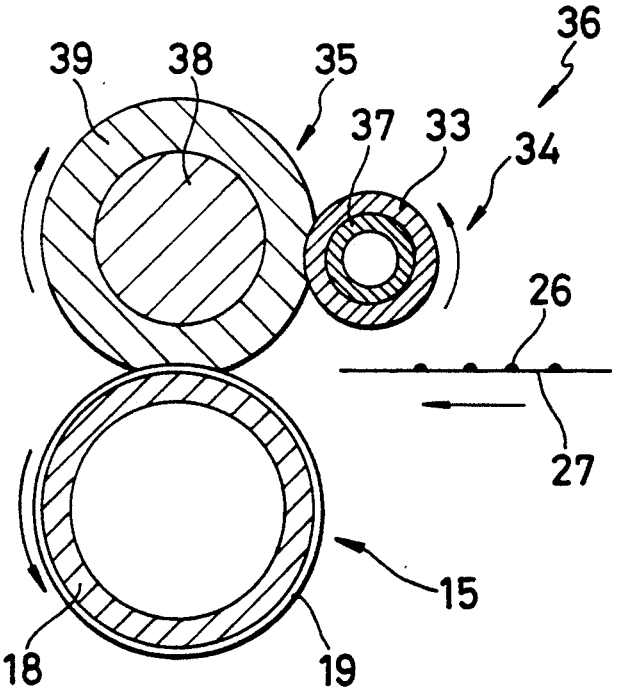
FIG. 7 is a vertical sectional side view illustrating a second modification of the fixing device shown in FIG. 1.

The present embodiment describes the fixing device 10 which has been provided with the fixing roller 14 with the heating element 21 incorporated therein, as the heater placed on the path for conveying the printing sheet 27. However, the present invention is not necessarily limited to the above construction. As shown in FIG. 7, a fixing device 36 formed with a heater produced by causing a heating roller 34 composed of a heating element 33 to press against a fixing roller 35, can also be used. The fixing device 36 is of a structure wherein the heating element 33 which is produced by dispersing particles of ceramic having a negative resistance-temperature coefficient into a binding member and which has a positive resistance-temperature coefficient, is externally mounted on a cylindrical support member 37. The fixing roller 35 is constructed in such a manner that an elastic member 39 such as silicone rubber, fluororubber having excellent heat insulating properties is externally mounted on a support member 38.

In the fixing device 36 constructed as described above, the fixing roller 35 is heated by the heating roller 34 and each of toner images 26 is fixed onto a printing sheet 27 based on the amount of heat generated by the fixing roller 35.

Figure 8:
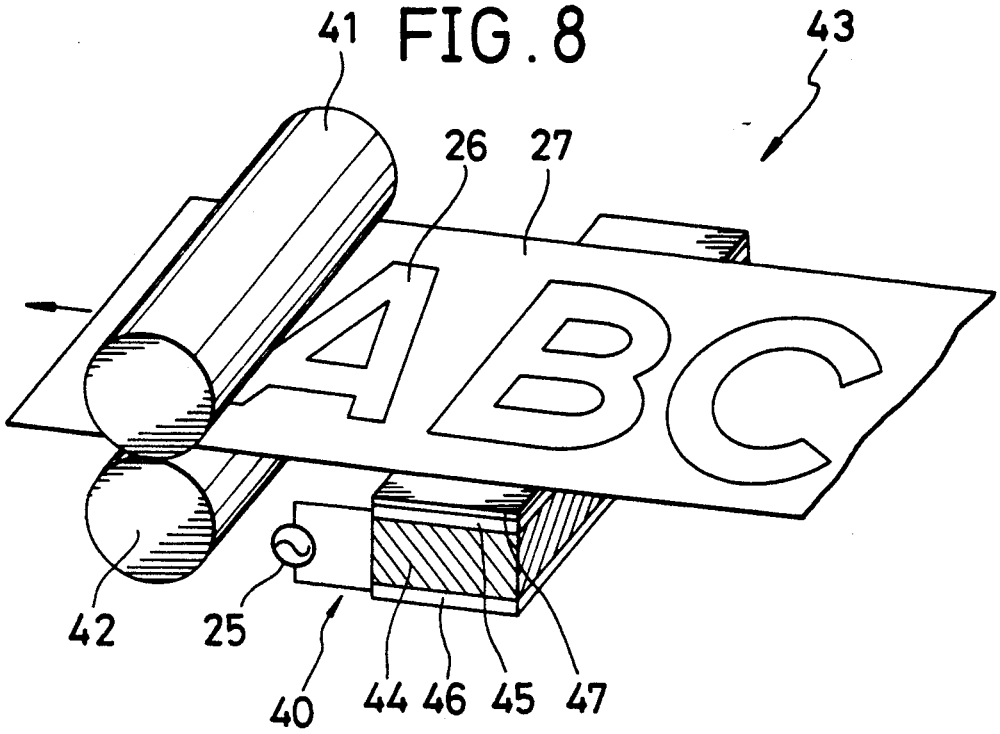
FIG. 8 is a perspective view showing a third modification of the fixing device shown in FIG. 1.
Figure 9:
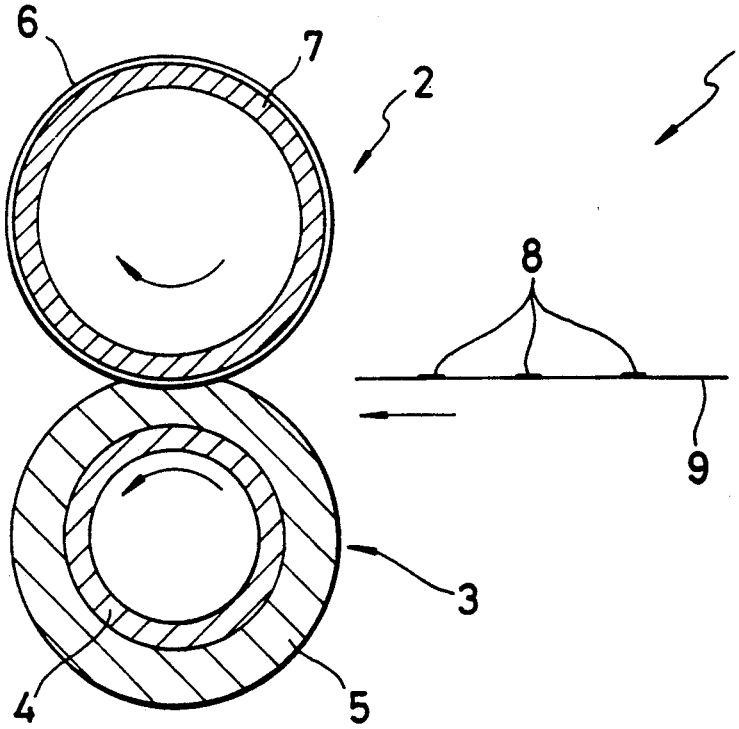
FIG. 9 is a vertical sectional side view showing a conventional fixing device.

As illustrated in FIG. 8, a fixing device 43 of a type wherein a flat heater 40 and a pair of conveying rollers 41, 42 are successively placed on a path for conveying a printing sheet 27, can also be used. In the fixing device 43, the heater 40 is of a structure wherein a heating element 44 which is formed by dispersing particles of ceramic having a negative resistance-temperature coefficient into a binding member and which has a positive resistance-temperature coefficient, is shaped in flat form, electrode layers 45, 46 formed of metal films are respectively formed onto the upper and lower surfaces of the heating element 44 and a protective coat 47 such as tetrafluoroethylene having excellent heat resistance, skidness and resistance to wear is formed on the electrode layer 45 in such a manner that the surface of the protective coat 47 is held in contact with the printing sheet 27.

In the fixing device 43 constructed as described above, each of toner images 26 on the printing sheet 27, which passes through the upper surface of the heater 40 in a contacted state, is heated by the heating element 44 and fixed onto the printing sheet 27. Then, the printing sheet 27 is conveyed between the conveying rollers 41 and 42. It is unnecessary to bring the upper surface of the heater 40 into contact with the printing sheet 27 at all times. The heater 40 may be disposed on the surface of the printing sheet 27 in an opposing relationship to each other. In addition, electrode layers may be provided on the front and back surfaces of the heating element 44 or the left and right surfaces corresponding to the side faces thereof so as to horizontally energize the heating element 44.

Having now fully described the invention, it will be apparent to those skilled in the art that many changes and modifications can be made without departing from the spirit or scope of the invention as set forth herein.

What is claimed is:

1. A fixing device for heating toner images formed on a recording medium with a heater to thereby fix said toner images on said recording medium, characterized in that said heater comprises a heating element having a positive resistance-temperature coefficient and formed by dispersing particles of ceramic having a negative resistance-temperature coefficient into a binding member.

2. A fixing device according to claim 1, wherein said ceramic having the negative resistance-temperature coefficient comprises a ferrite.

3. A fixing device according to claim 1, wherein said ceramic having the negative resistance-temperature coefficient comprises an Mn-Zn ferrite.

4. A fixing device for heating toner images formed on a recording medium with an outer peripheral surface of a heater so as to fix said toner images on said recording medium, characterized in that a heating element formed by dispersing particles of ceramic having a negative resistance-temperature coefficient into a binding member is shaped in the form of a cylinder and a heat-shrinkable tubing is mounted on the outer peripheral surface of said heating element, thereby forming said heater.

5. A fixing device according to claim 4, wherein the roughness of the outer peripheral surface of said heating element ranges from 30(μm) to 80(μm).

6. A fixing device according to claims 4 or 5, wherein said surface roughness and the thickness of said heat-shrinkable tubing are determined so as to meet the following equation:

$$R \leqq t \leqq 60R$$

where R: surface roughness t: thickness of heat-shrinkable tubing.

7. The fixing device of claim 1, wherein said heating element has a positive resistance-temperature coefficient at least at temperatures greater than 200° C.

8. The fixing device of claim 1, wherein said binding member includes polyether-etherketone.

9. The fixing device of claim 3, wherein said ceramic is ground into grains having an average diameter of 3 μm.

10. The fixing device of claim 1, wherein said heating element has a hollow cylindrical shape having a radial thickness of approximately 2 mm.

11. The fixing device of claim 1, wherein said heating element is in the shape of a hollow cylinder having a radial thickness T and a diameter D, and wherein $$\frac{1}{32} < \frac{T}{D} < \frac{1}{8}.$$

12. The fixing device of claim 4, wherein said heating element has a positive resistance-temperature coefficient at least at temperatures greater than 200° C.

13. The fixing device of claim 4, wherein said cylinder has a tubular shape with a thickness T and a diameter D, and wherein $$\frac{1}{32} < \frac{T}{D} < \frac{1}{8}.$$

14. The fixing device of claim 4, wherein said ceramic having the negative resistance-temperature coefficient comprises an Mn-Zn ferrite.

* * * * *

UNITED STATES PATENT AND TRADEMARK OFFICE

CERTIFICATE OF CORRECTION

PATENT NO. : 5,280,329

DATED : January 18, 1994

INVENTOR(S) : Ryozo AKIYAMA, et al.

It is certified that error appears in the above-indentified patent and that said Letters Patent is hereby corrected as shown below:

On the title page, Item [75], the inventorship should read as follows:

--Ryozo Akiyama; Yoshimitsu Ohtaka, both of Shizuoka, Japan--

Signed and Sealed this

Twelfth Day of July, 1994

Bruce Lehman

*Attest:*

BRUCE LEHMAN

*Attesting Officer*

*Commissioner of Patents and Trademarks*